US010414540B2

(12) United States Patent
Meicher et al.

(10) Patent No.: US 10,414,540 B2
(45) Date of Patent: Sep. 17, 2019

(54) TOILET SEAT PACKAGE

(71) Applicant: Kohler Co., Kohler, WI (US)

(72) Inventors: Jacob Barry Meicher, Sheboygan, WI (US); Peter William Swart, Oostburg, WI (US); Lawrence E. Duwell, Adell, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 15/945,354

(22) Filed: Apr. 4, 2018

(65) Prior Publication Data

US 2018/0290788 A1 Oct. 11, 2018

Related U.S. Application Data

(60) Provisional application No. 62/481,941, filed on Apr. 5, 2017.

(51) Int. Cl.

| | |
|---|---|
| ***B65D 5/08*** | (2006.01) |
| ***B65D 5/50*** | (2006.01) |
| ***B65D 45/32*** | (2006.01) |
| ***B65D 25/10*** | (2006.01) |
| ***B65D 5/42*** | (2006.01) |

(52) U.S. Cl.
CPC ..... *B65D 5/5028* (2013.01); *B65D 5/08* (2013.01); *B65D 5/4204* (2013.01); *B65D 25/102* (2013.01); *B65D 45/322* (2013.01)

(58) Field of Classification Search
CPC .... B65D 5/643; B65D 5/6611; B65D 5/6647; B65D 5/6673; B65D 5/08
USPC ..... 229/125.38
See application file for complete search history.

(56) References Cited

U.S. PATENT DOCUMENTS

| | | | | |
|---|---|---|---|---|
| 1,842,299 | A | 1/1932 | Stedman | |
| 3,949,932 | A * | 4/1976 | Shore | B65D 59/08 229/103.2 |
| 4,158,410 | A | 6/1979 | Novatny | |
| 5,405,003 | A * | 4/1995 | Schmidt | B65D 73/0007 206/303 |
| 5,890,650 | A | 4/1999 | Penson | |
| 9,221,577 | B2 | 12/2015 | Curtis et al. | |
| 2016/0341966 | A1 | 11/2016 | Palanisamy et al. | |

FOREIGN PATENT DOCUMENTS

| | | |
|---|---|---|
| EP | 0 317 244 A1 | 5/1989 |
| EP | 0 844 188 B1 | 10/2001 |
| EP | 1 329 390 A1 | 7/2003 |

* cited by examiner

*Primary Examiner* — King M Chu
(74) *Attorney, Agent, or Firm* — Foley & Lardner LLP

(57) ABSTRACT

A toilet seat package includes a toilet seat, a cover, and a band. The cover encloses the toilet seat. The cover includes a first side, a second side, a third side, a fourth side, a fifth side, a sixth side, a first slot, and a second slot. The third side is contiguous with the first side and the second side. The fourth side is contiguous with the first side. The fifth side is contiguous with the first side, the second side, the third side, and the fourth side. The sixth side is contiguous with the first side, the second side, the third side, and the fourth side. The first slot extends from the first side through the fifth side. The second slot extends from the second side through the fifth side. An interaction between the band and the toilet seat biases the toilet seat against the sixth side.

20 Claims, 6 Drawing Sheets

TOILET SEAT PACKAGE

CROSS-REFERENCE TO RELATED PATENT APPLICATION

The present application claims the benefit of, and priority to, U.S. Provisional Patent Application No. 62/481,941, filed Apr. 5, 2017, the contents of which are incorporated herein by reference in their entirety.

BACKGROUND

The present disclosure relates generally to the field of toilet seats. Specifically, the present application relates to packaging for a toilet seat for use in the containment and shipping of the toilet seat.

SUMMARY

One embodiment relates to a toilet seat package. The toilet seat package includes a toilet seat, a cover, and a band. The cover encloses the toilet seat. The cover includes a first side, a second side, a third side, a fourth side, a fifth side, a sixth side, a first slot, and a second slot. The third side is contiguous with the first side and the second side. The fourth side is contiguous with the first side. The fifth side is contiguous with the first side, the second side, the third side, and the fourth side. The sixth side is contiguous with the first side, the second side, the third side, and the fourth side. The first slot extends from the first side through the fifth side. The second slot extends from the second side through the fifth side. The band interfaces with the first side, the second side, the fifth side, the sixth side, and the toilet seat. The band is positioned within the first slot and the second slot. An interaction between the band and the toilet seat biases the toilet seat against the sixth side.

Another embodiment relates to a cover for enclosing a toilet seat. The cover includes a first side, a second side, a third side, a fourth side, a fifth side, a sixth side, a first slot, and a second slot. The third side is contiguous with the first side and the second side. The fourth side is contiguous with the first side. The fifth side is contiguous with the first side, the second side, the third side, and the fourth side. The sixth side is contiguous with the first side, the second side, the third side, and the fourth side. The first slot extends from the first side through the fifth side. The second slot extends from the second side through the fifth side. The first slot and the second slot are configured to cooperate to provide a continuous slot from a location on the first side, across the fifth side, and to a location on the second side. The first slot is aligned with the second slot such that the continuous slot is configured to be substantially straight.

Yet another embodiment relates to a toilet seat package. The toilet seat package includes a toilet seat, a cover, and a band. The cover encloses the toilet seat. The cover includes a first side, a second side, a third side, a fourth side, a fifth side, a sixth side, a first slot, and a second slot. The third side is contiguous with the first side and the second side. The fourth side is contiguous with the first side. The fifth side is contiguous with the first side, the second side, the third side, and the fourth side. The sixth side is contiguous with the first side, the second side, the third side, and the fourth side. The first slot extends from the first side through the fifth side. The second slot extends from the second side through the fifth side. The band interfaces with the first side, the second side, the fifth side, the sixth side, and the toilet seat. The band is positioned within the first slot and the second slot. The first slot and the second slot are configured to cooperate to provide a continuous slot from a location on the first side, across the fifth side, and to a location on the second side. The first slot is aligned with the second slot such that the continuous slot is configured to be substantially straight.

The foregoing summary is illustrative only and is not intended to be in any way limiting. In addition to the illustrative aspects, embodiments, and features described above, further aspects, embodiments, and features will become apparent by reference to the drawings and the following description.

BRIEF DESCRIPTION OF THE DRAWINGS

Further features, characteristics, and advantages of the present disclosure will become apparent to a person of ordinary skill in the art from the following detailed description of embodiments of the present disclosure, made with reference to the drawings annexed, in which like reference characters refer to like elements.

DETAILED DESCRIPTION

Various aspects of the disclosure will now be described with regard to certain examples and embodiments, which are intended to illustrate but not to limit the disclosure. Nothing in this disclosure is intended to imply that any particular feature or characteristic of the disclosed embodiments is essential. The scope of protection is not defined by any particular embodiment described herein. Before turning to the figures, which illustrate exemplary embodiments in detail, it should be understood that the application is not limited to the details or methodology set forth in the description or illustrated in the figures. It should also be understood that the terminology is for the purpose of the descriptions only and should not be regarded as limiting.

Toilet seat assemblies (e.g., a toilet seat and lid assembly) may be provided in packages for shipping and sale within a wholesale or retail environment (either for sale by themselves or in conjunction with a larger toilet assembly). The packaging is intended both to contain the toilet seat assembly and its subcomponents (e.g., bolts, fasteners, covers, etc.) and to protect such items during shipping and display. With conventional packaging for toilet seat assemblies, however, the items within the packaging may move about freely within the packaging, which can cause damage to parts of the seat assembly. For example, the connection points that extend from a rear of the seat assembly for attaching the seat assembly to a toilet may crash into the walls of the packaging and/or be crushed during transportation. In conventional packaging, foam blocks or corrugate padding is commonly used to prevent the seat assembly from moving around and becoming damaged. It would be advantageous to provide an improved packaging system to reduce or eliminate damage that may occur during transport of the seat assembly.

According to an exemplary embodiment, a toilet seat package is provided with a plastic strap to prevent the toilet seat from moving within the package to reduce or eliminate the possibility of damage to the connectors of the toilet seat. The package may include one or more features (e.g., slots) configured to retain the strap in a desired position so as to secure the toilet seat assembly in place within the package. The toilet seat package disclosed may provide a cost benefit when compared to current packaging that uses foam blocks or corrugate padding, as well as environmental benefits by reducing the materials needed to transport the toilet seat without damage.

Figure 1:
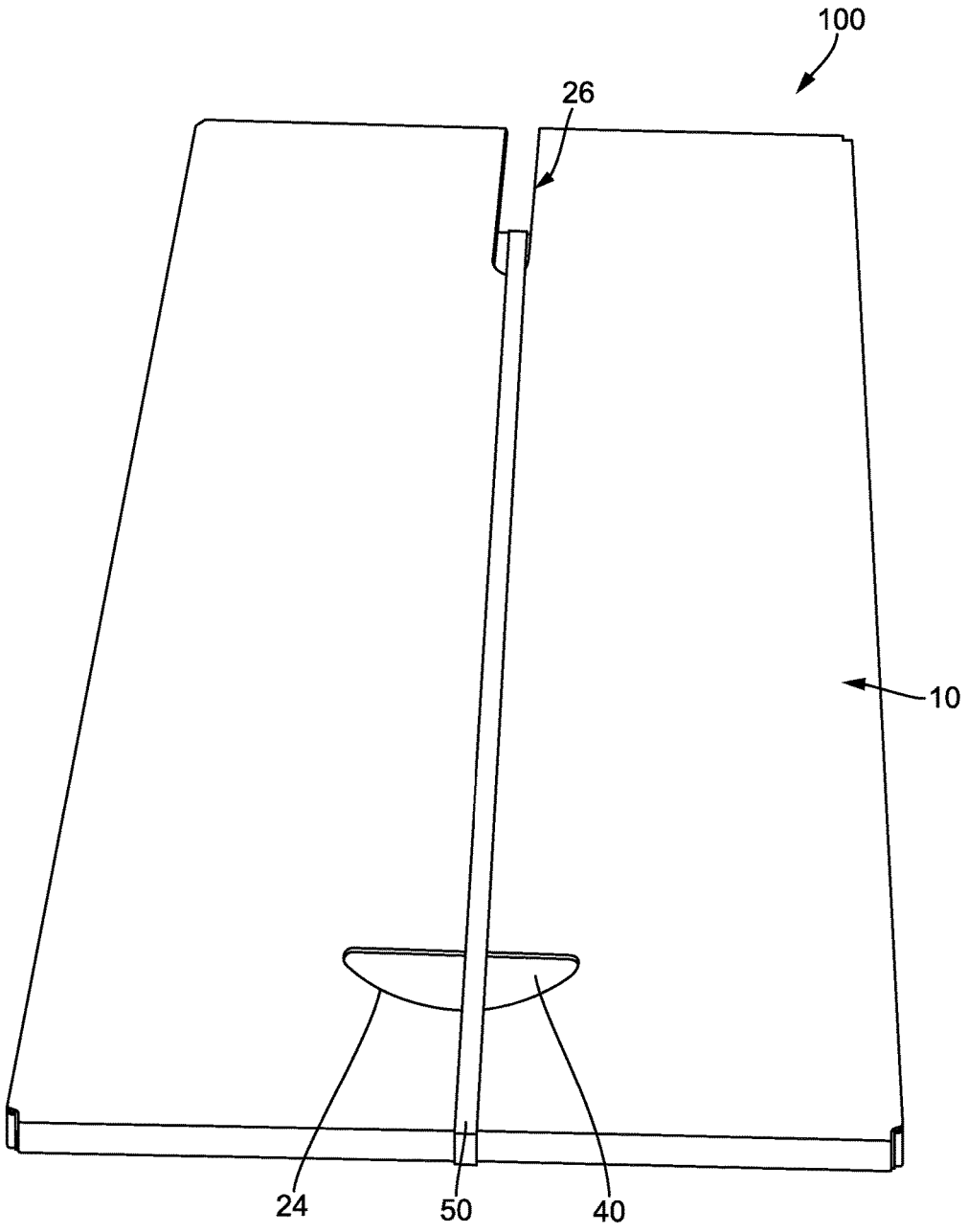
FIG. 1 is a front view of a toilet seat package according to an exemplary embodiment.

Referring to FIG. 1, a front view of a toilet seat package 100 is shown according to an exemplary embodiment. The toilet seat package 100 includes a cover 10, a toilet seat 40, and a band 50 (e.g., a strap, belt, leash, tie, etc.). The cover 10 includes a first slot 26 and the band 50 extends into and through the first slot 26 and around the cover 10 in a longitudinal direction. The first slot 26 is located or positioned intermediate or between the connectors of the toilet seat and engages a rear surface of the toilet seat assembly, and retains the seat assembly in a position such that the connectors do not engage or crash into a rear or back wall of the packaging during shipment. The cover 10 is operable between a first state and a second state. In the first state, the cover 10 is substantially flat. For example, the cover 10 may be cut from a continuous sheet of cardboard in the first state, and may be stored flat in the first state. In the second state, the cover 10 is configured to enclose the toilet seat 40. For example, the cover 10 may be in the first state, inserted into a bending machine which folds and bends the cover 10, the toilet seat 40 may be inserted into the cover, and the cover 10 may be closed using the band 50 such that the cover 10 is in the second state.

The cover 10 is sized and shaped to contain a toilet seat assembly (referred to herein for brevity simply as a "toilet seat," although it should be understood that this may include both a seat and a lid, just a seat, or just a lid, and may also include additional components such as electronics, bidet attachments, and/or other items in cases where additional features are provided with the toilet seat). In some embodiments, the cover 10 is sized and shaped for a round toilet seat. In some embodiments, the cover 10 is sized and shaped for an elongated toilet seat or a toilet seat having other desired configurations. In some embodiments, the cover 10 includes diagrams, text, symbols, or other characters and images to depict the contents and specifications of the cover 10.

Figure 2A:
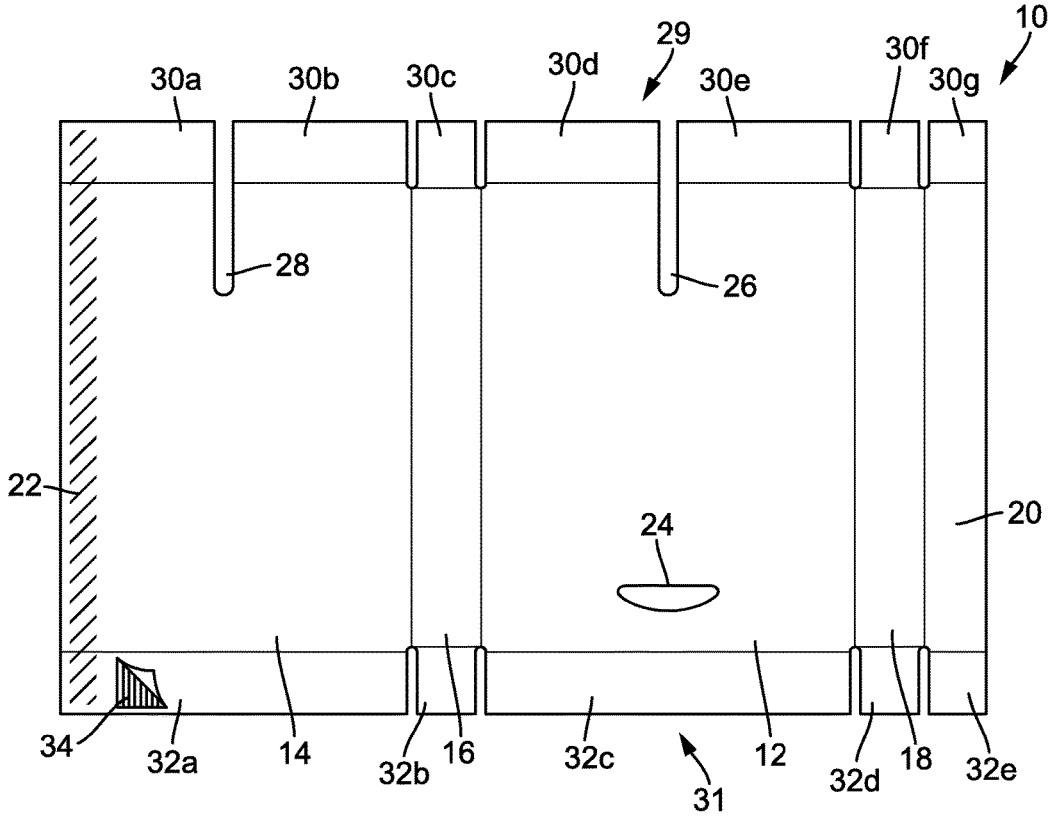
FIG. 2A is a schematic view of the toilet seat package of FIG. 1 according to an exemplary embodiment.

Referring to FIG. 2A, a schematic view of the cover 10 is shown according to an exemplary embodiment prior to folding the box to form a package such as shown in FIG. 1. As described above, the cover 10 is sized and shaped to contain a toilet seat. The cover 10 includes a first side 12, a second side 14, a third side 16, and a fourth side 18. The third side 16 is contiguous with both the first side 12 and the second side 14. The fourth side 18 is contiguous with the first side 12. The cover 10 also includes a coupling flap 20 which is contiguous with the fourth side 18. The first side 12 includes an aperture 24 and the first slot 26. The second side 14 includes a second slot 28 and a coupler 22. The cover 10 also includes a fifth side 29 which is contiguous with the first side 12, the second side 14, the third side 16, and the fourth side 18 (i.e., through various portions of the fifth side 29, etc.). The cover 10 also includes a sixth side 31 which is contiguous with the first side 12, the second side 14, the third side 16, and the fourth side 18 (i.e., through various portions of the sixth side 31, etc.). The fifth side 29 includes a first portion 30*a* and a second portion 30*b* which are contiguous with the second side 14, a third portion 30*c* which is contiguous with the third side 16, a fourth portion 30*d* and a fifth portion 30*e* which are contiguous with the first side 12, a sixth portion 30*f* which is contiguous with the fourth side 18, and a seventh portion 30*g* which is contiguous with the coupling flap 20. The sixth side 31 includes a first portion 32*a* which is contiguous with the second side 14, a second portion 32*b* which is contiguous with the third side 16, a third portion 32*c* which is contiguous with the first side 12, a fourth portion 32*d* which is contiguous with the fourth side 18, and a fifth portion 32*e* which is contiguous with the coupling flap 20. In various embodiments, the third side 16 is substantially identical to the fourth side 18.

The aperture 24 provides a window for a customer to see or feel the toilet seat when inside the cover 10. The aperture 24 may be circular, semicircular, elliptical, semielliptical, or any other shape. The aperture 24 is large enough to provide a clear view of the toilet seat without decreasing the structural integrity of the cover 10. The aperture 24 provides a user with an ability to see a color, configuration, and/or texture of the toilet seat 40 without removing the toilet seat 40 from the toilet seat package 100.

The first slot 26 extends from the first side 12 through the fifth side 29 (e.g., across the fifth side 29, bisecting the fifth side 29, etc.). Specifically, the first slot 26 is located proximate an edge of the first side 12 which is contiguous with the fifth side 29. The first slot 26 is rectangular and is configured to receive a band 50. The first slot 26 terminates in an end within the first side 12. This end may be rounded, rectangular, or otherwise similarly shaped. According to other exemplary embodiments, the first slot 26 may have other configurations. The fourth portion 30*d* and the fifth portion 30*e* extend away from the first side 12 on either side of the first slot 26. The third portion 32*c* of the bottom extends away from the first side 12.

The second slot 28 extends from the second side 14 through the fifth side 29 (e.g., across the fifth side 29, bisecting the fifth side 29, etc.). Specifically, the second slot 28 is located proximate an edge of the second side 14 which is contiguous with the fifth side 29. The second slot 28 is rectangular and is configured to receive a band 50. The second slot 28 terminates in an end within the second side 14. This end may be rounded, rectangular, or otherwise similarly shaped. According to other exemplary embodiments, the second slot 28 may have other configurations. The first portion 30*a* and the second portion 30*b* extend away from the second side 14 on either side of the second slot 28. The first portion 32*a* of the bottom extends away from the second side 14.

The first slot 26 and the second slot 28 are configured to cooperate to provide a continuous slot when the cover 10 is assembled (e.g., when the cover 10 is enclosing the toilet seat 40, etc.). The continuous slot extends from a location on the first side 12, across the fifth side 29, and to a location on the second side 14. The first slot 26 and the second slot 28 are aligned (e.g., are centered on the same plane, etc.) such that the continuous slot is configured to be substantially straight. By creating the continuous slot, the first slot 26 and the second slot 28 enable to band 50 to contact the toilet seat 40. This contact maintains the toilet seat 40 in the cover 10 and minimizes movement of the toilet seat 40 within the cover 10, thereby providing optimal protection to the toilet seat 40. If the first slot 26 and second slot 28 were not capable of cooperating to form a continuous slot or were not capable of facilitating contact between the band 50 and the toilet seat 40, the toilet seat 40 would be able to move an undesirable amount within the cover 10 and thus the toilet seat 40 could not be optimally protected.

The first slot 26 is centered on a first plane bisecting the first side 12 such that the first side 12 is symmetrical about the first plane (e.g., such that half of the first slot 26 is on one side of the first plane and such that half of the first slot 26 is on another side of the first plane, etc.). The second slot 28 is centered on a second plane bisecting the second side 14 such that the second side 14 is symmetrical about the second plane (e.g., such that half of the second slot 28 is on one side of the second plane and such that half of the second slot 28 is on another side of the second plane, etc.).

In various embodiments, the first side 12, the second side 14, and the fifth side 29 are configured such that the first slot 26 is aligned with the second slot 28. The first slot 26 and the second slot 28 may be centered on a plane that is substantially parallel to a plane upon which the third side 16 or the fourth side 18 is disposed. The first slot 26 may be identical to the second slot 28. The first slot 26 and the second slot 28 may be symmetrical.

The second side 14 also includes the coupler 22, which provides coupling between the second side 14 and the coupling flap 20. In some embodiments, the coupler 22 includes an adhesive (e.g., tape, glue, etc.). The first portion 32*a* may include a coupling mechanism 34 that allows the sixth side 31 to be coupled to one another. In some embodiments, coupling mechanism 34 is an adhesive (e.g., tape, glue, etc.). According to other exemplary embodiments, the box may be configured to allow it to be folded to form the packaging without the use of adhesives or other fasteners.

The third side 16 is located between the first side 12 and the second side 14. The third portion 30*c* extends away from the third side 16 upward and the second portion 32*b* extends away from the third side 16 downward. Coupled to the other side of the first side 12 is the fourth side 18. The sixth portion 30*f* extends away from the fourth side 18 upward and the fourth portion 32*d* extends away from the fourth side 18 downward. On the other side of the fourth side 18 is the coupling flap 20 which overlaps with the coupler 22 of the second side 14. The seventh portion 30*g* extends away from the coupling flap 20 upward and the fifth portion 32*e* extends away from the coupling flap 20 downward.

Once assembled, the first side 12, the second side 14, the third side 16, the fourth side 18, the coupling flap 20, the fifth side 29, and the sixth side 31 is assembled, a rectangular prism is formed that creates a cavity for receiving a toilet seat.

Figure 2B:
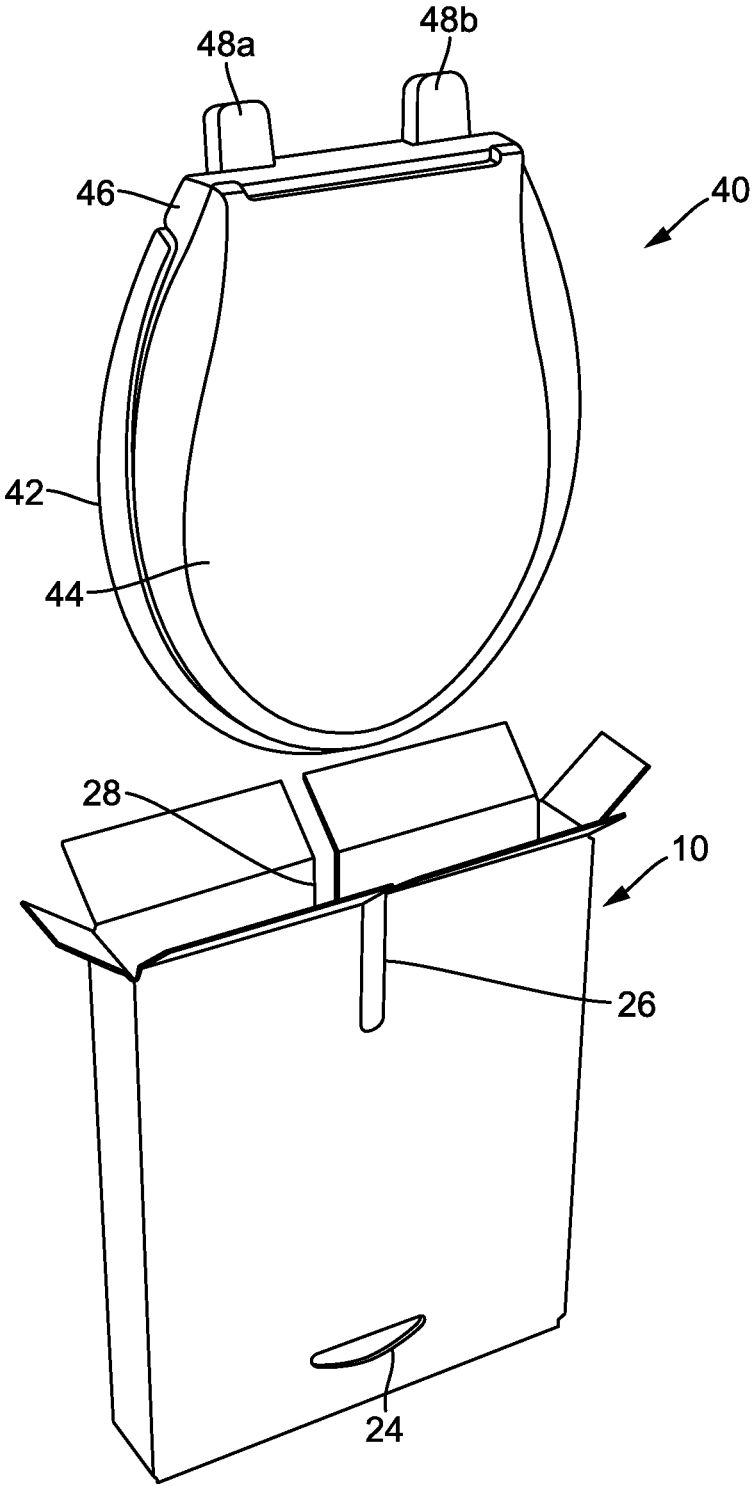
FIG. 2B is a perspective view of a toilet seat being inserted into the toilet seat package of FIG. 1, according to an exemplary embodiment.

Referring to FIG. 2B, a perspective view of a toilet seat 40 being inserted into the cover 10 is shown according to an exemplary embodiment. The toilet seat 40 includes a seat 42 (e.g., ring, etc.), a lid 44 (e.g., cover, etc.), a base 46 (e.g., a hinge assembly or the like) that couples the seat 42 to the lid 44, a first connector 48*a* and a second connector 48*b*. The first connector 48*a* and the second connector 48*b* extend from the base 46. The lid 44 and the seat 42 are rotatably coupled to the base 46.

The toilet seat 40 is inserted into the cover 10 with the first connector 48*a* and the second connector 48*b* upward and the fifth side 29 of the cover 10 can then be closed to secure the toilet seat 40 in the cover 10. The first connector 48*a* and the second connector 48*b* are positioned proximate the fifth side 29 within the cover 10. The band 50 interfaces with the toilet seat 40 between the first connector 48*a* and the second connector 48*b*. Although FIG. 2B illustrates a configuration in which the toilet seat 40 is lowered into the cover 10, according to other exemplary embodiments, the seat may be introduced into the box horizontally (e.g., with the box laying on a surface, the seat may be slid into the box).

Figure 2C:
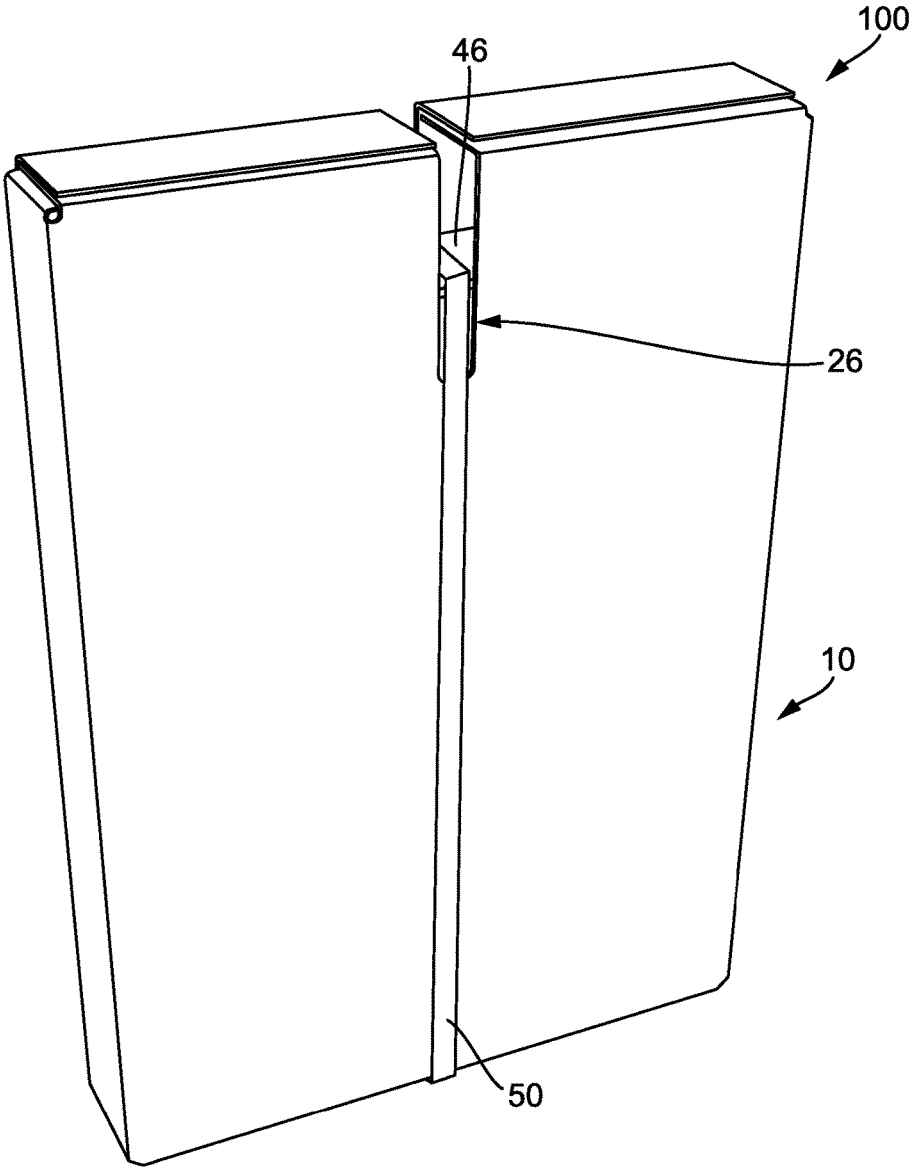
FIG. 2C is a perspective view of the toilet seat package of FIG. 1, according to an exemplary embodiment.

Referring to FIG. 2C, a perspective view of the toilet seat package 100 is shown according to an exemplary embodiment. Once the toilet seat 40 is enclosed in the cover 10, the band 50 can be wrapped through the first slot 26 and the second slot 28 to secure the toilet seat 40 in position. The band 50 interfaces with the first side 12, the second side 14, the fifth side 29, the sixth side 31, and the toilet seat 40. This interaction causes the band 50 to bias (e.g., press, force, push, etc.) the toilet seat 40 against the sixth side 31 (e.g., against an inner surface of the sixth side 31, etc.). In this way, the band 50 functions to minimize movement of the toilet seat 40 within the cover 10, thereby increasing desirability of the toilet seat package 100. For example, the band 50 may increase protection for the toilet seat 40 in the event that the toilet seat package 100 is dropped by ensuring that the toilet seat 40 remains substantially enclosed within the cover 10. Additionally, the cover 10 facilitates enclosure of the first connector 48*a* and the second connector 48*b* while minimizing movement of the toilet seat 40 within the cover 10 and simplifying manufacturing requirements of the cover 10. Rather than having a complex geometry and requires multiple assembly processes (e.g., bends, folds, etc.) to cover the first connector 48*a* and the second connector 48*b* and provide for minimal movement of the toilet seat 40, the cover 10 may be assembled after only a few bends because of the first slot 26, the second slot 28, the band 50, and the configuration of the fifth side 29.

As shown in FIG. 2C, the band 50 directly engages or contacts both the cover 10 and the base 46 of the toilet seat 40. Therefore, the first slot 26 and the second slot 28 extend from the fifth side 29 far enough that the base 46 is exposed. In some embodiments, the first slot 26 and the second slot 28 do not extend past the base 46, but instead are flush with the base 46. In some embodiments, the cover 10 includes another slots other than the first slot 26 and the second slot 28, such that the band 50 extends between the first slot 26, the second slot 28, and the other slots.

According to an exemplary embodiment, the band 50 is made of a relatively rigid material (e.g., plastic, metal, etc.). In some embodiments, the band 50 is made of a cable tie with a ratchet mechanism and a gear rack to secure the band 50 in place. In some embodiments, the band 50 may be secured in place using an adhesive (tape, glue, etc.). In some embodiments, one or more additional bands may be wrapped around the cover 10 perpendicular to the band 50.

Figure 3A:
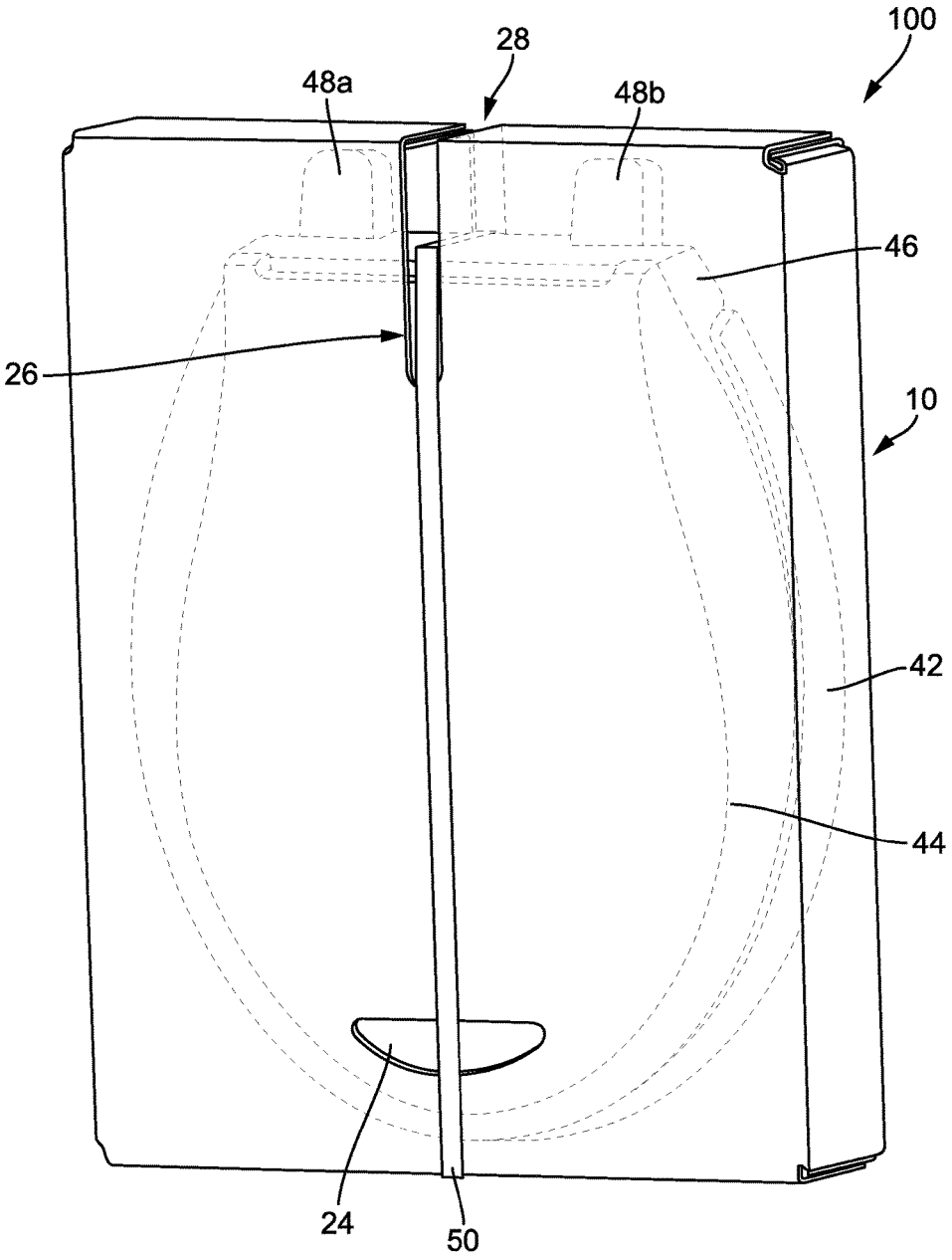
FIG. 3A is a perspective view of the toilet seat package of FIG. 1 showing an arrangement of contents of the toilet seat package, according to an exemplary embodiment.
Figure 3B:
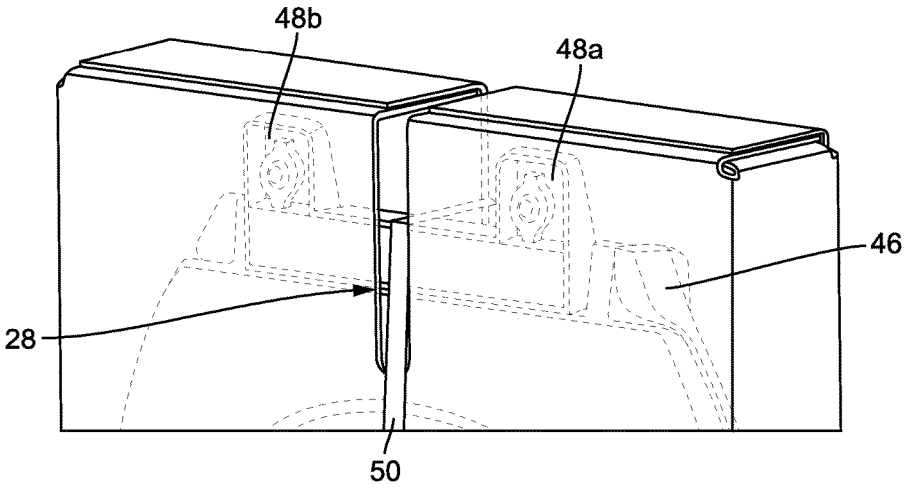
FIG. 3B is a close up perspective view of a back of the toilet seat package of FIG. 3A, according to an exemplary embodiment.
Figure 3C:
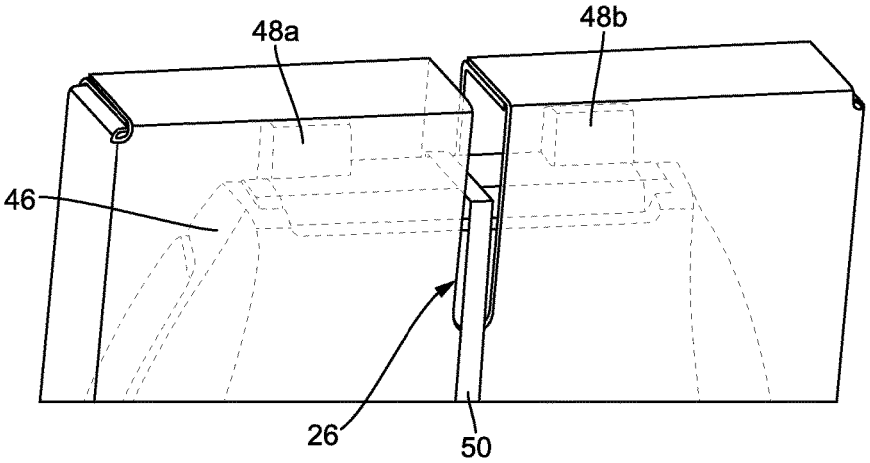
FIG. 3C is a close up perspective view of a front of the toilet seat package of FIG. 3A, according to an exemplary embodiment.

Referring to FIGS. 3A-3C, a see-though perspective view of the toilet seat package 100 is shown to illustrate an arrangement of contents of the toilet seat package 100 according to an exemplary embodiment. The seat 42 abuts the second side 14 of the cover 10 and the lid 44 abuts the first side 12 of the cover 10. The first connector 48*a* and the second connector 48*b* of the toilet seat 40 are securely located on either side of the first slot 26 and the second slot 28 and are spaced apart from the top of the cover 10 by the band 50 that is positioned between the first connector 48*a* and the second connector 48*b*. The band 50 secures the toilet seat 40 to the sixth side 31 of the cover 10. In some embodiments, the cover 10 is rectangular, as shown. In some embodiments, the cover 10 has angled corners to create a cover 10 that is shaped more closely to the shape of the toilet seat 40. In some embodiments, the aperture 24 is located near the sixth side 32 of the cover 10. In some embodiments, the aperture 24 is located in a middle, side or top of the cover 10. In some embodiments, the first slot 26 and the second slot 28 are equivalent to one another. In some embodiments, the first slot 26 and the second slot 28 are different lengths, such that one is longer than the other. In some embodiments, the first slot 26 and the second slot 28 are of a length such that each slot extends a certain length past the base 46 on the respective side.

According to any embodiment, a toilet seat package includes a box with a slot and a band. However, other embodiments may include or omit certain components to suit particular applications. While the embodiments described herein relate to packaging for a toilet seat assembly, it should be understood that the packaging techniques described, providing a slot in a package and banding that extends through the slot and around the package, could be used for various articles that may be subject to damage during transport (e.g., faucets, handles, accessories, etc.).

In various embodiments, the cover 10 is constructed from cardboard. In other embodiments, the cover 10 is constructed from Hexacomb® or honeycomb corrugate material, firm cardboard, wood, aluminum, plastic, polymers, relatively thin polymeric sheet, composites, and other similar materials.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure. As utilized herein, the term "contiguous" indicates that either two elements are integrally connected along a border between the elements and/or that the two elements are coupled together along a border between the elements.

The construction and arrangement of the elements of the toilet seat package as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the disclosure.

Other substitutions, modifications, changes and omissions may also be made in the design, operating conditions and arrangement of the various exemplary embodiments without departing from the scope of the present disclosure. For example, any element (e.g., box, slot, band, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the disclosure.

What is claimed is:

1. A toilet seat package comprising:

a toilet seat;

a cover enclosing the toilet seat, the cover comprising:

a first side;

a second side;

a third side contiguous with the first side and the second side;

a fourth side contiguous with the first side;

a fifth side contiguous with the first side, the second side, the third side, and the fourth side;

a sixth side contiguous with the first side, the second side, the third side, and the fourth side;

a first slot extending from the first side through the fifth side; and a second slot extending from the second side through the fifth side; and a band interfacing with the first side, the second side, the fifth side, the sixth side, and the toilet seat, the band being positioned within the first slot and the second slot;

wherein an interaction between the band and the toilet seat biases the toilet seat against the sixth side.

2. The toilet seat package of claim 1, wherein:

the cover is rectangular; and the third side is substantially identical to the fourth side.

3. The toilet seat package of claim 1, wherein the cover is constructed from cardboard.

4. The toilet seat package of claim 1, wherein the first side comprises an aperture positioned over at least a portion of the toilet seat.

5. The toilet seat package of claim 1, wherein:

the toilet seat comprises:

a base;

a first connector protruding from the base; and a second connector protruding from the base; and the first connector and the second connector are positioned proximate the third side.

6. The toilet seat package of claim 5, wherein the band interfaces with the base between the first connector and the second connector.

7. The toilet seat package of claim 6, wherein:

the toilet seat further comprises a lid rotatably coupled to the base; and the band interfaces with the lid.

8. The toilet seat package of claim 1, wherein the cover further comprises a coupling flap contiguous with the fourth side.

9. The toilet seat package of claim 8, wherein:

the second side comprises a coupler;

the coupling flap is configured to be coupled to the coupler such that the fourth side is held adjacent the second side.

10. A cover for enclosing a toilet seat, the cover comprising:

a first side;

a second side;

a third side contiguous with the first side and the second side;

a fourth side contiguous with the first side;

a fifth side contiguous with the first side, the second side, the third side, and the fourth side;

a sixth side contiguous with the first side, the second side, the third side, and the fourth side;

a first slot extending from the first side through the fifth side; and a second slot extending from the second side through the fifth side; and wherein the first slot and the second slot are configured to cooperate to provide a continuous slot from a location on the first side, across the fifth side, and to a location on the second side; and wherein the first slot is aligned with the second slot such that the continuous slot is configured to be substantially straight.

11. The cover of claim 10, wherein:

the cover is rectangular; and the third side is substantially identical to the fourth side.

12. The cover of claim 10, wherein the cover is constructed from cardboard.

13. The cover of claim 10, wherein the first slot is substantially identical to the second slot.

14. The cover of claim 10, wherein:

the first slot is centered on a first plane bisecting the first side such that the first side is symmetrical about the first plane; and the second slot is centered on a second plane bisecting the second side such that the second side is symmetrical about the second plane.

15. The cover of claim 10, wherein:

the cover is operable between a first state and a second state;

the cover is substantially flat in the first state; and the cover is configured to enclose a toilet seat in the second state.

16. A toilet seat package comprising:

a toilet seat;

a cover enclosing the toilet seat, the cover comprising:

a first side;

a second side;

a third side contiguous with the first side and the second side;

a fourth side contiguous with the first side;

a fifth side contiguous with the first side, the second side, the third side, and the fourth side;

a sixth side contiguous with the first side, the second side, the third side, and the fourth side;

a first slot extending from the first side through the fifth side; and a second slot extending from the second side through the fifth side; and a band interfacing with the first side, the second side, the fifth side, the sixth side, and the toilet seat, the band being positioned within the first slot and the second slot;

wherein the first slot and the second slot are configured to cooperate to provide a continuous slot from a location on the first side, across the fifth side, and to a location on the second side; and wherein the first slot is aligned with the second slot such that the continuous slot is configured to be substantially straight.

17. The toilet seat package of claim 16, wherein:

the first slot is centered on a first plane bisecting the first side such that the first side is symmetrical about the first plane; and the second slot is centered on a second plane bisecting the second side such that the second side is symmetrical about the second plane.

18. The toilet seat package of claim 16, wherein:

the cover is operable between a first state and a second state;

the cover is substantially flat in the first state; and the cover is configured to enclose a toilet seat in the second state.

19. The toilet seat package of claim 16, wherein an interaction between the band and the toilet seat biases the toilet seat against the sixth side.

20. The toilet seat package of claim 16, wherein:

the toilet seat comprises:

a base;

a lid rotatably coupled to the base;

a first connector protruding from the base; and a second connector protruding from the base;

the first connector and the second connector are positioned proximate the third side;

the band interfaces with the base between the first connector and the second connector; and the band interfaces with the lid.

* * * * *